US006135365A

United States Patent [19]

Kuwahara

[11] Patent Number: 6,135,365

[45] Date of Patent: Oct. 24, 2000

[54] AIR SPRAY GUN TYPE COATING DEVICE

[75] Inventor: Hiroomi Kuwahara, Hiroshima-Ken, Japan

[73] Assignee: Kako Zoki Co., Ltd, Hiroshima-Ken, Japan

[21] Appl. No.: 09/316,963

[22] Filed: May 24, 1999

[30] Foreign Application Priority Data

May 29, 1998 [JP] Japan ..... 10-166395

[51] Int. Cl.[7] ..... B05B 1/28

[52] U.S. Cl. ..... 239/296; 239/298

[58] Field of Search ..... 239/296, 290, 239/299, 300, 297, 298

[56] References Cited

U.S. PATENT DOCUMENTS

| | | | |
|---|---|---|---|
| 2,740,670 | 4/1956 | Harder | 239/296 |
| 3,038,750 | 6/1962 | Nielsen | 239/296 |
| 4,969,602 | 11/1990 | Scholl | 239/298 |
| 5,065,943 | 11/1991 | Boger et al. | 239/298 |
| 5,452,856 | 9/1995 | Pritchard | 239/297 |

*Primary Examiner*—Andres Hashnikow
*Assistant Examiner*—Davis Hwu
*Attorney, Agent, or Firm*—Venable; John P. Shannon

[57] ABSTRACT

The present invention is characterized by an air spray gun type coating device having a doughnut disk 1 in an outer circumferential direction perpendicular to a nozzle body 13, wherein plural through holes 3 are provided at equal intervals to an inside of a front face of the disk 1 so as to open from the rear to the front of the disk 1, and wherein plural exhaust nozzles 4 for spouting compressed air are provided at equal intervals to an outside of the front face of the disk 1 so as to surround coating material 7 spouted from the nozzle body 13.

12 Claims, 4 Drawing Sheets

(A)

(A)

(B)

AIR SPRAY GUN TYPE COATING DEVICE

BACKGROUND OF THE INVENTION

1. Field of the Invention

The present invention relates to an air gun device for spraying coating material to an object.

2. Prior Arts

FIG. 4 shows a conventional air spray gun type coating device having the following construction. The numeral 11 is a hand grip, 12 is an operating part, and 13 is a nozzle body. The hand grip 11 is provided with a compressed air intake 14, a lever adjusting thumb nut 15 and a compressed air adjusting thumb nut 16. The operating part 12 is provided with a lever 17, and the nozzle body 13 is provided with a coating bottle 18 by means of a pipe line 19. For use the lever 17 is pulled after connecting the compressed air intake 14 with a compressed air pipe 20. Then, compressed air is spouted from an air exhaust nozzle 13*a* of the nozzle body 13 via a required path. Here, coating material inside the coating bottle 18 spouts from a central nozzle 13*b* via the pipe line 19 due to a suction effect of spouted air.

As to spraying coating material in the above-mentioned device, an emitting direction thereof is fixed. However, the coating material is easily splashed by surrounding wind etc, thereby causing nonuniformal coating as well as reducing coating efficiency.

SUMMARY OF THE INVENTION AND ADVANTAGES

To achieve the above objects, an air spray gun type coating device according to the present invention comprises a nozzle body and a doughnut disk. The doughnut disk is fixed in an outer circumferential direction perpendicular to the nozzle body. Plural through holes are provided at equal intervals to an inside of a front face of the disk, and they open from the rear to the front of the disk. Plural exhaust nozzles for spouting compressed air are provided at equal intervals to an outside of the front face of the disk so as to surround coating material spouted from the nozzle body.

Therefore, the plural exhaust nozzles provided to the outside of the front face of the disk at equal intervals surround spouted spray liquid and prevent coating mist from splashing, thereby leading the coating mist to go straight without any crosswind effect (which is caused by displacing hands during work even in a windless condition).

Besides, the doughnut disk is formed to have an inclined face flaring from an inner hole thereof to the front, and plural through holes are provided to the inclined face.

In this construction, outside air flows from the rear of the doughnut disk through the above through holes, which accelerates a speed of the coating mist as well as increases efficiency of adhesion.

Moreover, the exhaust nozzles for spouting the compressed air are provided to have an inclination about 1°~10° against a center of the coating material spouted from the nozzle body.

In this construction, the compressed air spouted from the exhaust nozzles in the outside of the front face of the doughnut disk forms a spiral air curtain, which encircles the spouted spray liquid and its splashing mist, and leads them to go straight. Therefore, any crosswind influence is effectively prevented.

In effect, if a wind blows, for example, a breeze blows, the spray liquid badly splashes to the surroundings, thereby causing environmental pollution as well as decreasing adhesive efficiency of coating material to less than 50%. The present invention, however, certainly prevents these problems.

Furthermore, a particle velocity of spouted coating material is uniform from the center to the edge of a pattern form of a coated face, thereby effecting a uniform coating thickness as well as a sharp border of the coated face. Accordingly, fine coating is achieved without any nonuniformal spot and liquid drop. In addition, because of no adhesive waste of the coating material, economical as well as coating efficiency is increased. In the conventional device, the coating material bounces in coating corners or angles. The present invention, however, settles these problems with the effect of the above spiral air curtain.

BRIEF DESCRIPTION OF THE DRAWINGS

FIG. 1 (A) is a perspective view, and FIG. 1(B) is a sectional view taken along the line X—X of FIG. 1 (A).

PREFERRED EMBODIMENTS OF THE PRESENT INVENTION

Figure 1:
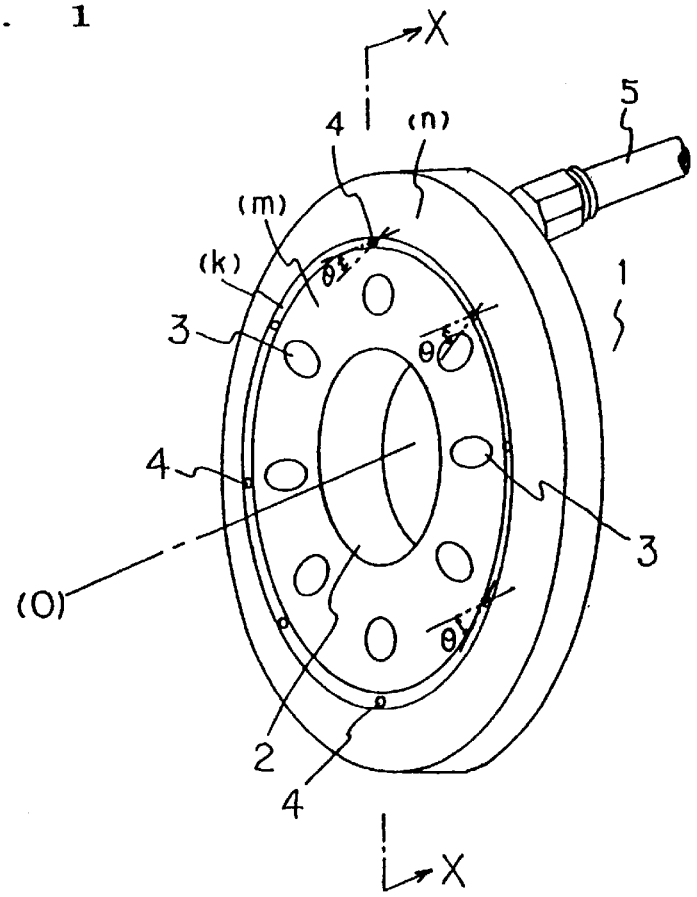
FIG. 1 shows a disk according to the present invention.
Figure 1:
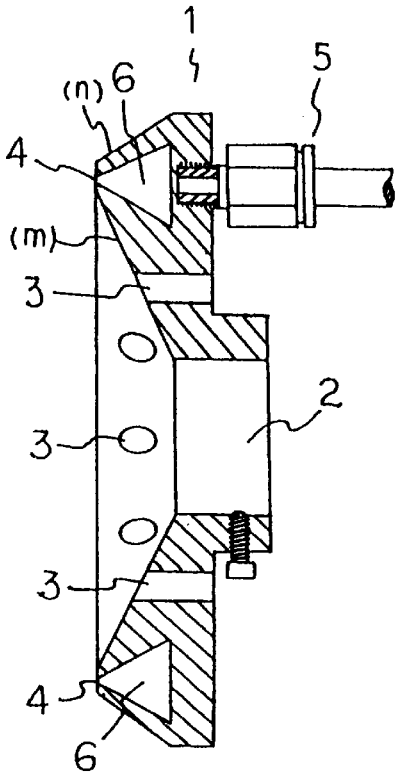
Figure 2:
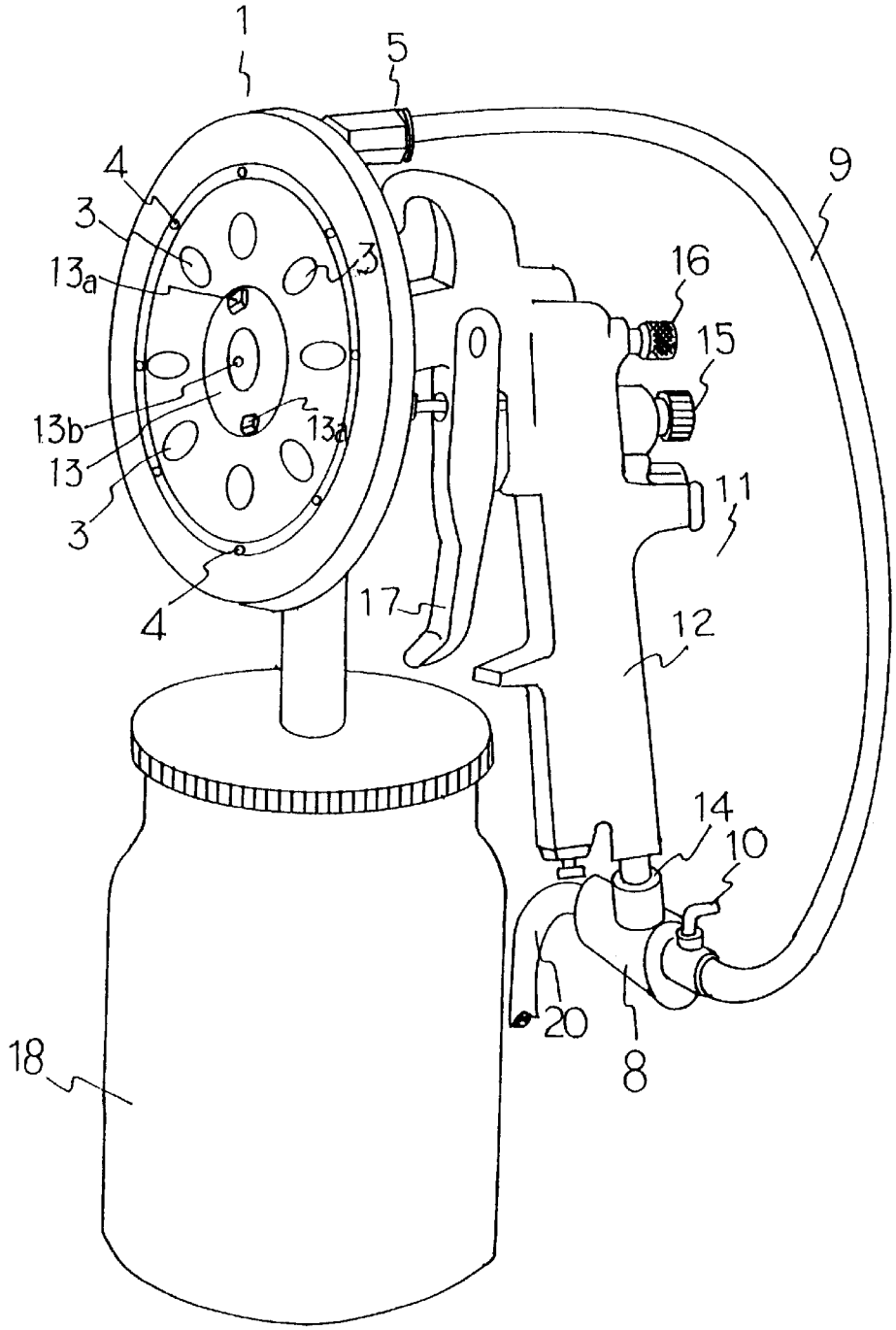
FIG. 2 is a perspective view showing the above disk fixed to a device according to the present invention.
Figure 3:
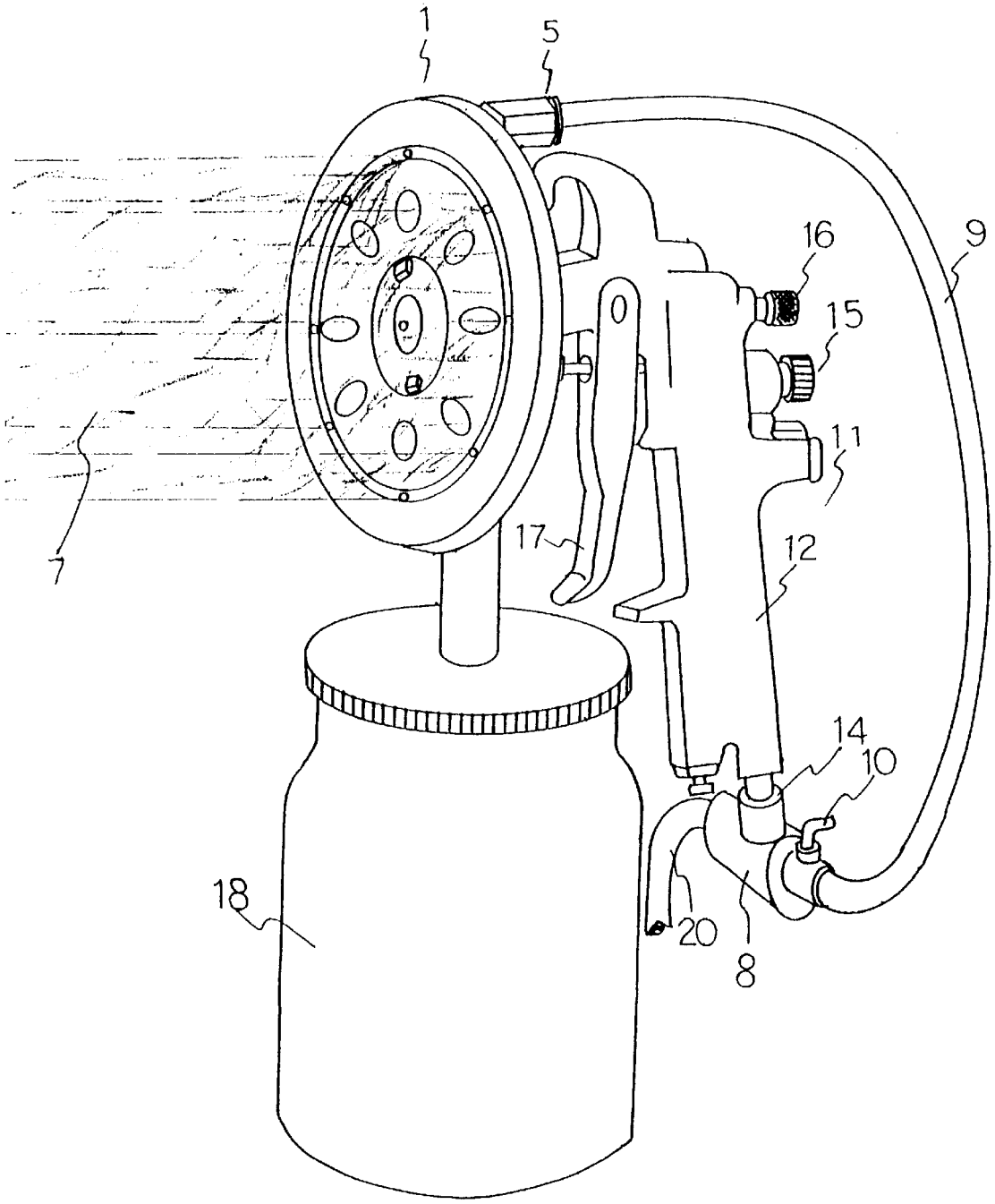
FIG. 3 is a view showing a working condition of the device in FIG. 2.
Figure 4:
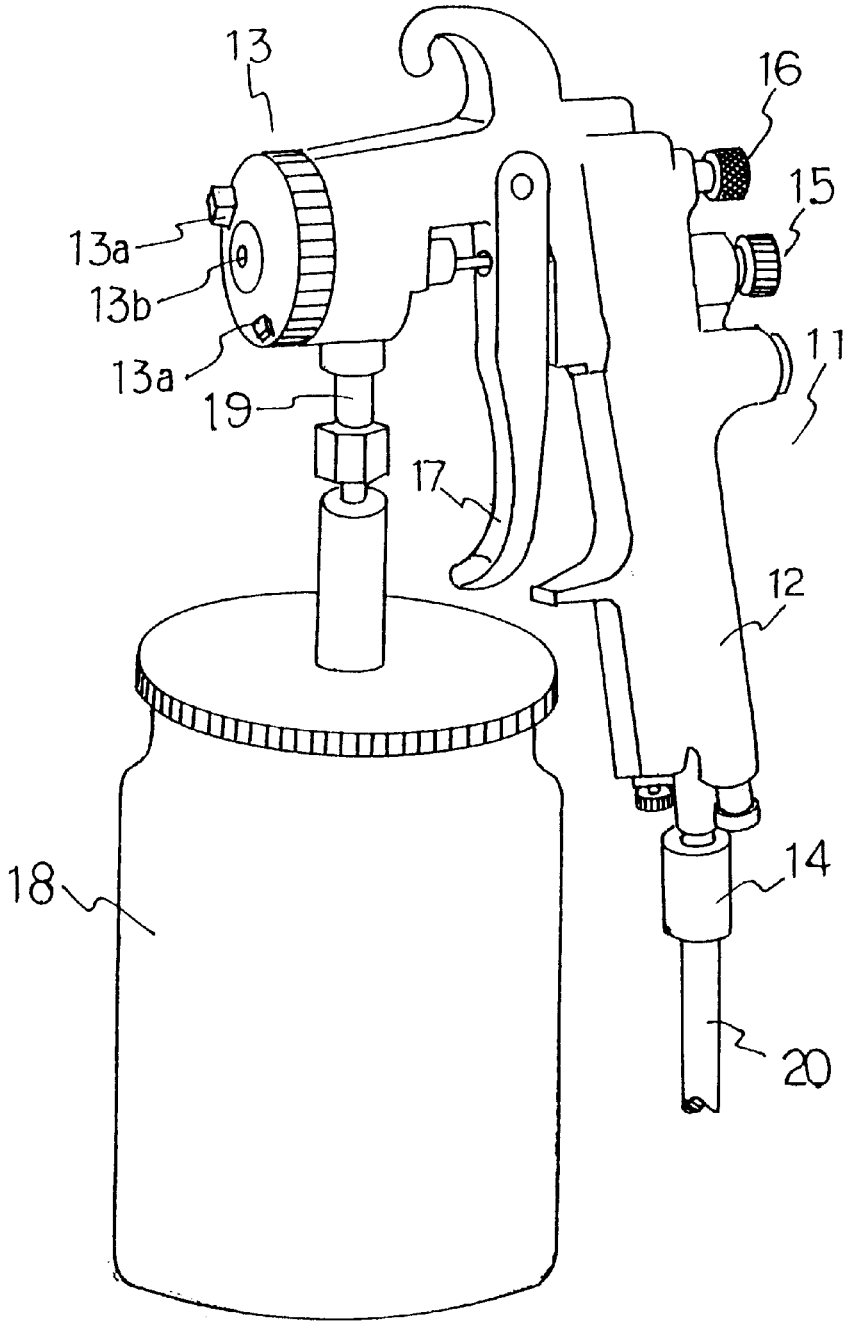
FIG. 4 is a perspective view of a conventional device.

A preferred embodiment of this invention is described according to FIG. 1, FIG. 2 and FIG. 3.

A disk 1 is made of synthetic resin material, and formed in doughnut. An inner radius 2 thereof is the same as an outer radius of a nozzle body 13 of a hand spray gun. The disk 1 is fitted to the outer circumference of the nozzle body 13 as described later.

The above disk 1 has an inclined face (m) which flares toward a front face of its thickness from an inner hole 2 in which the nozzle body 13 is inserted. Besides, the inclined face (m) is provided with plural through holes 3 piercing from a rear face to a front face of the disk 1 at equal intervals so as to surround the inner hole 2.

On the other hand, an outer circumferential face of the disk 1 has an inclined face (n) which narrows toward the front face. Plural exhaust nozzles 4 for spouting the compressed air are provided at equal intervals to a place (k) where the inclined face (n) meets the above inclined face (m). In addition, a compressed air introducing pipe 5 is provided to the rear face of the disk 1, and a compressed air path 6 is provided inside the disk 1.

In the above disk 1, each exhaust nozzle 4 for spouting the compressed air is adjustable to have a constant inclination against a parallel to a center of the nozzle body 13, namely a inclination θ of about 1°~10°. In this case, the revolving flow of air surrounds all around coating material 7 spouted from the nozzle body 13, thereby effectively preventing its splash to the outer circumference.

On being fixed to the air spray gun, as shown in FIG. 2, the above disk 1 is connected to a branch pipe 8 by means of the above compressed air introducing pipe 5 and a hose 9. The branch pipe 8 is provided to a compressed air intake 14 of the air spray gun. Here, the numeral 10 is a switching valve fitted to the hose 9.

For spraying the coating material, a lever 17 of an operating part 12 is pulled, and the coating material inside a coating bottle 18 spouts from the nozzle body 13. Besides, in the present invention, the switching valve 10 is opened in accordance with the above conventional operation. Then, the compressed air spouts from the exhaust nozzles 4 at the outside of the front face of the above disk 1 and surrounds all around the coating material spouted from the above nozzle body 13, thereby causing no coating material to splash unexpectedly to the circumference.

As the compressed air spouts from the above exhaust nozzles 4, outside air flows toward the inside through the through holes 3 provided to the disk 1. Therefore, the coating material spouts from the nozzle body 13 is properly refined, and besides, flow velocity of the coating material increases to improve adhesion effectively.

In addition, in the present invention, the outer circumferential face of the disk 1 is formed into the inclined face (n) which narrows toward the center of the front face, thereby causing no eddy current in the rear of each exhaust nozzle 4.

Moreover, in spouting the compressed air from the exhaust nozzles 4, each exhaust hole is inclined in an inclination θ of about 1°~10° so as to form the revolving flow of air due to a multiplier effect with the coating material spouted from the center. Accordingly, the revolving flow of air surrounds all around the coating material, thereby preventing its splash as much as possible as well as effecting uniform coating.

Though, the above inclination θ can be inclined to the right or the left, the left is preferable in consideration of the earth rotation (for the northern hemishere). Furthermore, it is preferable that the through hole 3 provided to the inside of the front face of the disk 1 is not located in the same radial line of the exhaust nozzle 4 for spouting the compressed air provided to the outside. In other words, each exhaust nozzle 4 is preferably located in the middle of two adjacent through holes 3 (vide FIG. 3).

What is claimed is:

1. An air spray gun type coating device comprising a nozzle body and a doughnut disk having an inner hole:

wherein said doughnut disk is positioned circumferentially around and fixed to said nozzle body:

wherein plural through holes are provided at equal intervals on a front face of said disk, said through holes piercing from the rear to the front of the disk and being in fluid communication with ambient air at the rear of the disk; and wherein plural exhaust nozzles for spouting compressed air are provided at equal intervals on the front face of said disk radially outside said through holes so as to surround coating material spouted from the nozzle body.

2. An air spray gun type coating device as set forth in claim 1:

wherein said doughnut disk has an inclined face (m) flaring from the inner hole to the front of the disk; and wherein said plural through holes are provided at equal intervals in said inclined face.

3. An air spray gun type coating device as set forth in claim 1:

wherein said plural exhaust nozzles for spouting compressed air have an inclination of about 1° to about 10° so as to form a spiral flow of air.

4. An air spray gun type coating device as set forth in claim 1:

wherein an inclined face (n) is formed at an outer circumferential edge of said front face, said inclined face tapering at the front of the disk.

5. An air spray gun type coating device as set forth in claim 2:

wherein said plural exhaust nozzles for spouting compressed air have an inclination of about 1° to about 10° so as to form a spiral flow of air.

6. An air spray gun type coating device as set forth in claim 2:

wherein an inclined face (n) is formed at an outer circumferential edge of said front face, said inclined face tapering at the front of the disk.

7. An air spray gun type coating device as set forth in claim 3:

wherein an inclined face (n) is formed at an outer circumferential edge of said front face, said inclined face tapering at the front of the disk.

8. An air spray gun type coating device as set forth in claim 5:

wherein an inclined face (n) is formed at an outer circumferential edge of said front face, said inclined face tapering at the front of the disk.

9. An air spray gun type coating device as set forth in claim 3, wherein said plural exhaust nozzles are arranged in a circle, and said inclination is toward a direction tangential to said circle.

10. An air spray gun type coating device as set forth in claim 5, wherein said plural exhaust nozzles are arranged in a circle, and said inclination is toward a direction tangential to said circle.

11. An air spray gun type coating device as set forth in claim 2, wherein said through holes open through said inclined face.

12. An air spray gun type coating device as set forth in claim 1, wherein said doughnut disk defines a central axis, the exhaust nozzles each lie at a radius from the central axis, and the through holes lie off the radii of the exhaust nozzles.

* * * * *